US007039210B2

(12) United States Patent
Holland

(10) Patent No.: US 7,039,210 B2
(45) Date of Patent: May 2, 2006

(54) BRIEFCASE OR CARRYING CASE WITH INTEGRATED LOUDSPEAKER SYSTEM

(76) Inventor: Bert E. Holland, 211 Lakeview Ave., Ringwood, NJ (US) 07456

( * ) Notice: Subject to any disclaimer, the term of this patent is extended or adjusted under 35 U.S.C. 154(b) by 316 days.

(21) Appl. No.: 09/997,495

(22) Filed: Nov. 19, 2001

(65) Prior Publication Data

US 2002/0085730 A1 Jul. 4, 2002

(30) Foreign Application Priority Data

Nov. 17, 2000 (DE) ..... 200 19 525

(51) Int. Cl.
*H04R 1/02* (2006.01)
*H04R 9/06* (2006.01)

(52) U.S. Cl. ..... 381/334; 381/333; 381/388; 181/198; D3/218

(58) Field of Classification Search ..... 381/87, 381/332, 333, 334, 335, 336, 386, 388, 394, 381/395; 181/150, 186, 190, 197, 198, 199; 190/100, 109

See application file for complete search history.

(56) References Cited

U.S. PATENT DOCUMENTS

| | | | | | |
|---|---|---|---|---|---|
| 4,052,561 | A | * | 10/1977 | Molay | 16/249 |
| 4,076,957 | A | * | 2/1978 | Molay | 381/75 |
| 4,324,951 | A | * | 4/1982 | Brown | 381/77 |
| 4,939,912 | A | * | 7/1990 | Leonovich, Jr. | 312/237 |
| 5,046,104 | A | * | 9/1991 | Kloss | 181/151 |
| 5,390,246 | A | * | 2/1995 | Gay et al. | 381/306 |
| 5,533,097 | A | * | 7/1996 | Crane et al. | 379/58 |
| 6,073,770 | A | * | 6/2000 | Park | 206/522 |

* cited by examiner

*Primary Examiner*—Xu Mei

(57) ABSTRACT

Briefcase respectively carrying case for electronic devices or documents having a housing comprising a storage compartment arranged in the housing for storing at least one paper document, electronic device or object, at least one loudspeaker for reproduction of audio frequencies, which is mounted in either an outer or inner wall of the housing, wherein, when the document or electronic device is removed, the storage compartment may be used as loudspeaker enclosure for said at least one loudspeaker for reproduction of low frequencies.

19 Claims, 5 Drawing Sheets

BRIEFCASE OR CARRYING CASE WITH INTEGRATED LOUDSPEAKER SYSTEM

FIELD OF THE INVENTION

The present invention relates to a carrying case such as a briefcase with an integrated loudspeaker.

BACKGROUND OF THE INVENTION

The term "briefcase" or "carrying case" as used herein is intended to refer to a case with at least one exterior handle having at least one interior storage compartment intended for the protection and transport of items such as documents, papers, writing supplies, laptop computers, music players, video players, portable projectors, cell phones, calculators, portable digital assistants, electronic equipment, toys, compact discs, etc.

The term "loudspeaker" as used herein is intended to refer to a single electro-acoustic transducer for reproducing audio signals from electrical signals. Audio signals are reproduced by an individual loudspeaker unit or by an assemblage of such units typically mounted in a loudspeaker enclosure and referred to as a loudspeaker system. Loudspeaker enclosures typically are designed to reinforce the low frequency audio output of the loudspeakers. The reinforcement can be accomplished by means of a sealed loudspeaker enclosure (so called acoustic suspension), a ported loudspeaker enclosure (so called bass-reflex), or a loudspeaker enclosure featuring an additional, non-electric loudspeaker membrane (so called passive radiator).

Today's development in the field of electronics in the entrainment and multimedia business is dominated by the trend to design electronic devices, as for example laptop computers, video cameras and video players to be smaller and lighter. For some time now in this regard sacrifices have been made with regard to the sound quality of loudspeakers integrated into such electronic devices. It appears that the available loudspeaker enclosure volume in such portable devices is insufficient to provide a natural sound reproduction especially in the low frequency range. Should it be desired to provide accurate sound reproduction in conjunction with the use of such portable devices, then a separate loudspeaker system with adequate loudspeaker enclosure volume must either be transported to or otherwise provided for at the place of usage. Due to the size and weight of such loudspeaker systems, they are seldom transported to the place of use, so that the natural sound quality is sacrificed. On the other hand, however, the image or video quality of such electronic devices is constantly improving, with the result that presentations with such electronic devices are subject to a discrepancy between sound and image quality. Likewise in the case that a portable music player or laptop computer is used to provide music or speech reproduction the sound quality is sacrificed for the sake of portability.

OBJECT OF THE INVENTION

The principal object of the present invention is therefore to provide a briefcase or carrying case for electronic devices as well as for documents or other such items, wherein the briefcase or carrying case may both be used as a transport means as well as a portable loudspeaker system.

A further object of the present invention is to provide a lightweight portable loudspeaker system, which despite its lightweight provides satisfactory sound reproduction.

SUMMARY OF THE INVENTION

These objects are accomplished in this invention by a carrying case that comprises a loudspeaker, which is mounted in either an outer or inner wall of the carrying case, for reproduction of audio frequencies, in particular low frequencies. The carrying case further comprises a storage compartment for electronic devices and documents in the interior of the briefcase, which may be used as loudspeaker enclosure for improving the low-frequency acoustic reproduction of said loudspeaker.

By use of this storage compartment as loudspeaker enclosure when the electronic devices or documents are removed from the briefcase, the briefcase providing a loudspeaker arranged in one of the outer or inner walls nearly achieves the same sound quality as standard loudspeaker systems. Due to the fact that the enclosure volume may also be used as storage compartment for the electronic devices, in particular laptop computers or video players, and presentation devices, a considerable space advantage is accomplished.

In a preferred embodiment the housing and in particular the outer walls are manufactured of a light-weight material that has a high stiffness and at the same time a high damping. Undesired interference with the sound of the speaker due to vibration of the housing or the briefcase is thereby eliminated.

In a preferred embodiment, the housing of the briefcase comprises two mateable shells, which are relatively stiff and at the same time are of lightweight and which are connected by means of a hinge. Preferably this hinge is separable, so that the two shells may be set up separately. In this embodiment, each shell is provided with an additional inner wall in order to provide loudspeaker enclosure volumes for each of the integrated loudspeakers. In the same manner, the enclosure volume, which according to the invention is also used as a storage compartment, may be closed by means of this inner wall or lid. It may be provided that the inner wall is arranged as a lid in the form of a pan with a deep bottom. This pan-like lid may therefore serve as a storage compartment nested into an outside shell of the carrying case. When this compartment is used as an enclosure volume for the loudspeaker, the pan-like lid may be reversed so that the deep bottom no longer extends into the outside shell but rather protrudes outwardly. The enclosure volume can thus be increased to a maximum of twice its size. Also, it is provided that by means of a telescopic arrangement the enclosure volume may be increased to a multiple of its original size.

The storage compartment and the enclosure volume is lined with a padding, which on the one hand, protects the items, electronic devices or paper documents placed in the storage compartment during transportation and which, on the other hand, causes a preferred damping of the acoustic waves of the loudspeaker. The walls of the housing utilize a so-called sandwich construction, i.e. a multi-layered construction consisting of a first layer comprising a material with a maximum thickness of 4 mm and a high modulus of elasticity in shear, and of at least a second inner layer of material with a minimum thickness of 4 mm and a high shear modulus, high damping and low density, and of a third layer of material with a maximum thickness of 4 mm and a high modulus of elasticity in shear. It may however also be desired to design a sandwich structure of at least one outer layer of material with a maximum thickness of 4 mm and a high modulus of elasticity in shear and at least one inner layer of a material with a minimum thickness of 4 mm and a high shear modulus, high damping and a low density. It also may be desired to utilize one or more materials with anisotropic load-bearing characteristics in order to maximize the stiffness of the sandwich structure according to the shape and form of the carrying case shells.

The loudspeaker provided in the outer or inner wall of the briefcase is preferably arranged such that its membrane or its passive loudspeaker membrane is directed outwardly. According to another preferred embodiment further means for arranging objects and electronic devices in the interior of the briefcase such as storage compartment lid with spring latches and elastic gaskets serve together as passive loudspeaker membranes respectively as passive loudspeaker membrane suspensions for a passive/radiator loudspeaker system design.

Further, the housing may comprise an acoustic damping material of at least 3 mm thickness on the insides of the interior compartments.

In a further embodiment an electrical amplifier means for increasing and controlling the loudness of the audio signal fed to the loudspeaker is provided in the briefcase. Further, a volume control potentiometer may be provided. It is also preferred to provide interface means for connections such as a loudspeaker connection, a microphone connection and so on. By means of such an interface, it is possible to attach further loudspeakers as well as other electronic devices such as laptop computers, video players and recorders or audio recording and playing devices such as MP3 players and CD players.

The briefcase may in addition to the built-in amplifier comprise an internal energy source in the form of a battery or battery pack, which may be rechargeable or which may be attached to an external power source. It is preferred that the interface providing connection facilities also provides a connection for an external power supply such as an automotive battery, airplane power supply or solar cell power supply. The connection facilities may further provide means for sending and receiving audio signals or digital signals by means of radio or infrared frequencies. It is also preferred to provide means for connecting a remote control, which receives signals either by means of radio or by means of infrared frequency.

The housing may also comprise mounting means in order to mount the speaker either to a stand or to the wall.

BRIEF DESCRIPTION OF THE DRAWING

Further details, features and advantages of the invention will become apparent from the following description of a preferred embodiment of the briefcase according to the present invention with reference to the figures.

In the drawing.

SPECIFIC DESCRIPTION

Figure 1:
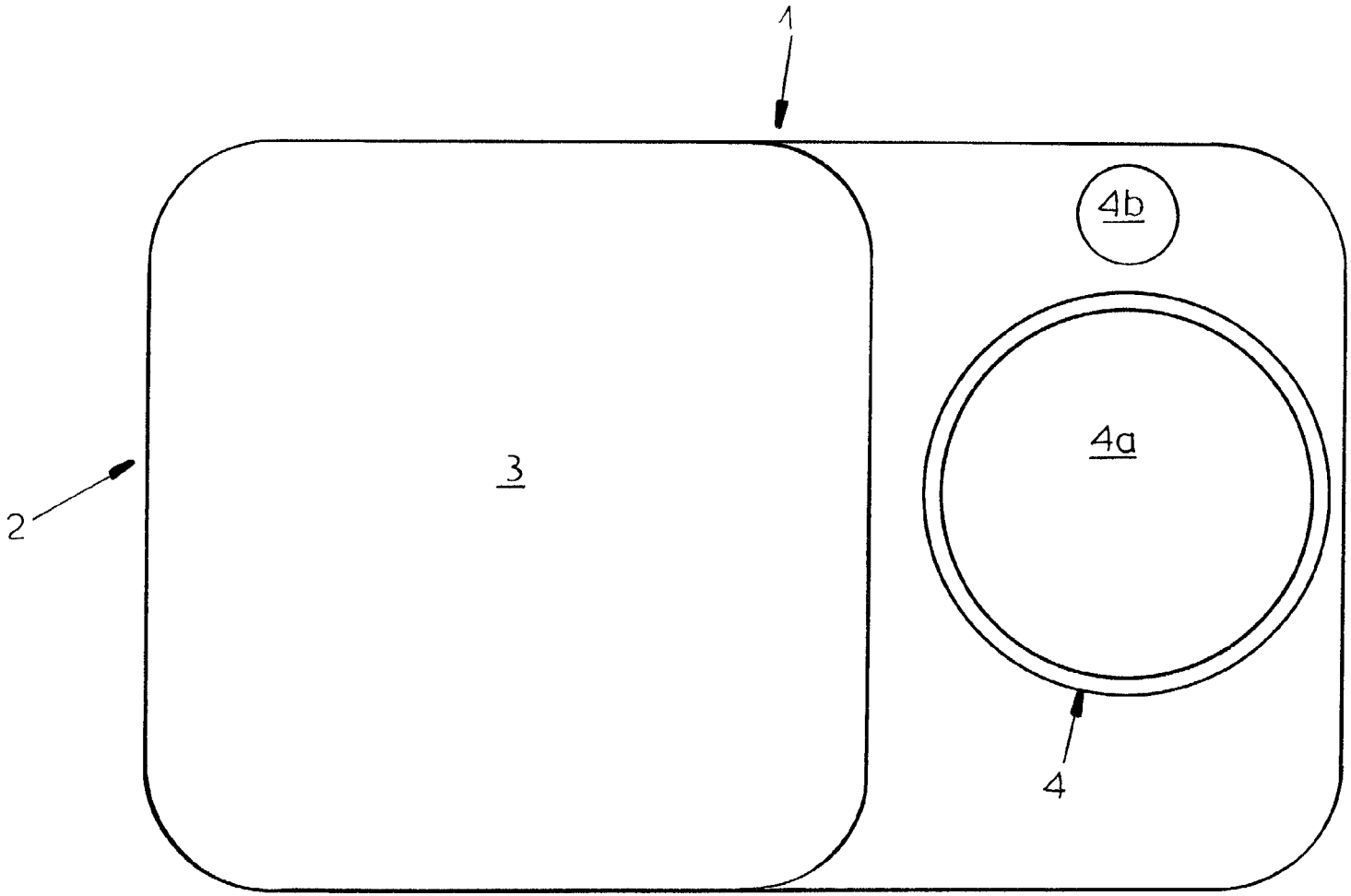
FIG. 1 is a top view of the briefcase according to the invention.
Figure 2:
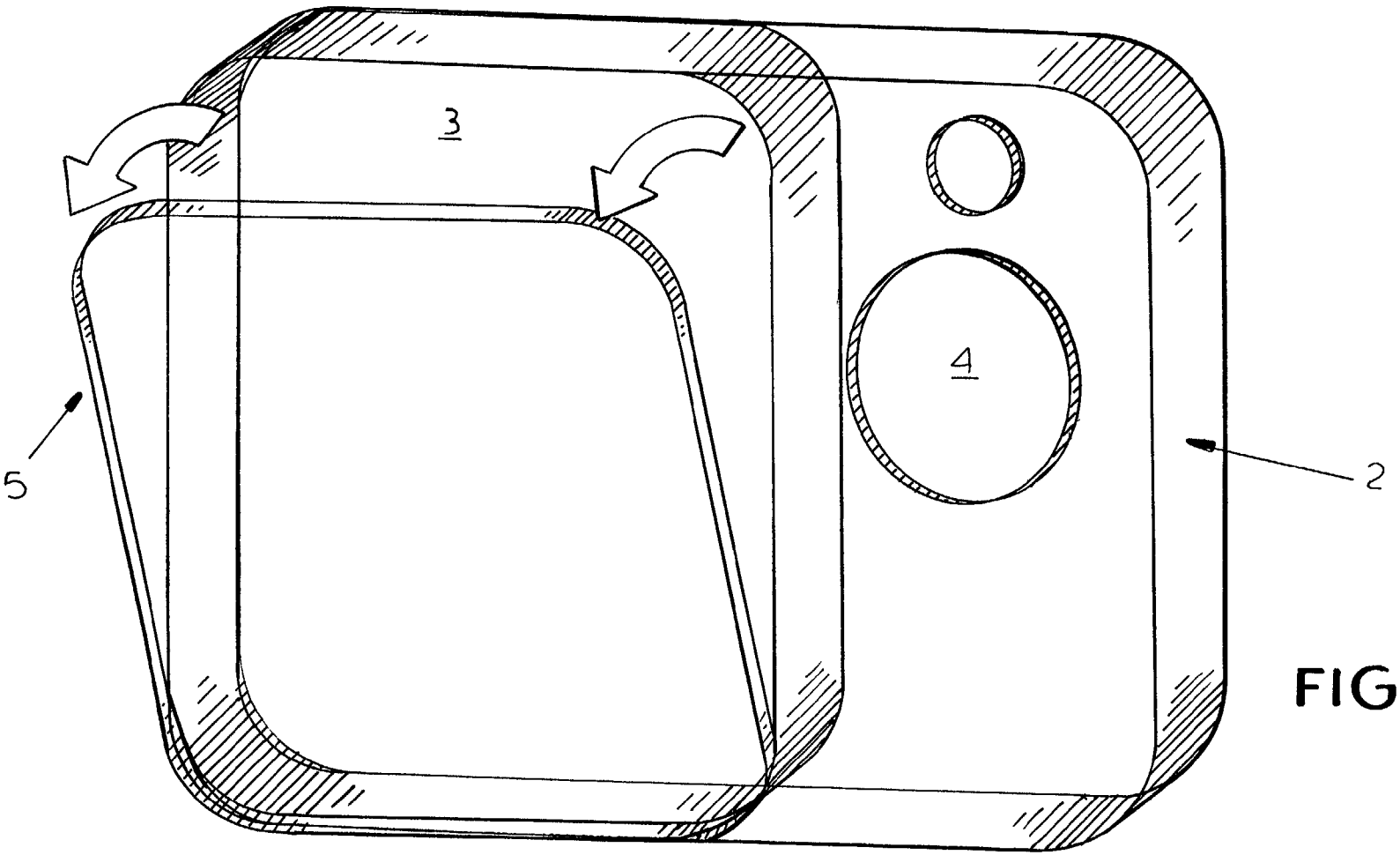
FIG. 2 is a perspective side view of the briefcase according to the invention.

In FIG. 1 a briefcase 1 is shown, which on its left side comprises a storage compartment 3 in a housing 2 and on its right side comprises a loudspeaker pair 4 consisting of a woofer 4*a* and a tweeter 4*b*. As shown in FIG. 2 the storage compartment 3 may be closed by an interior wall or lid 5.

Figure 3:
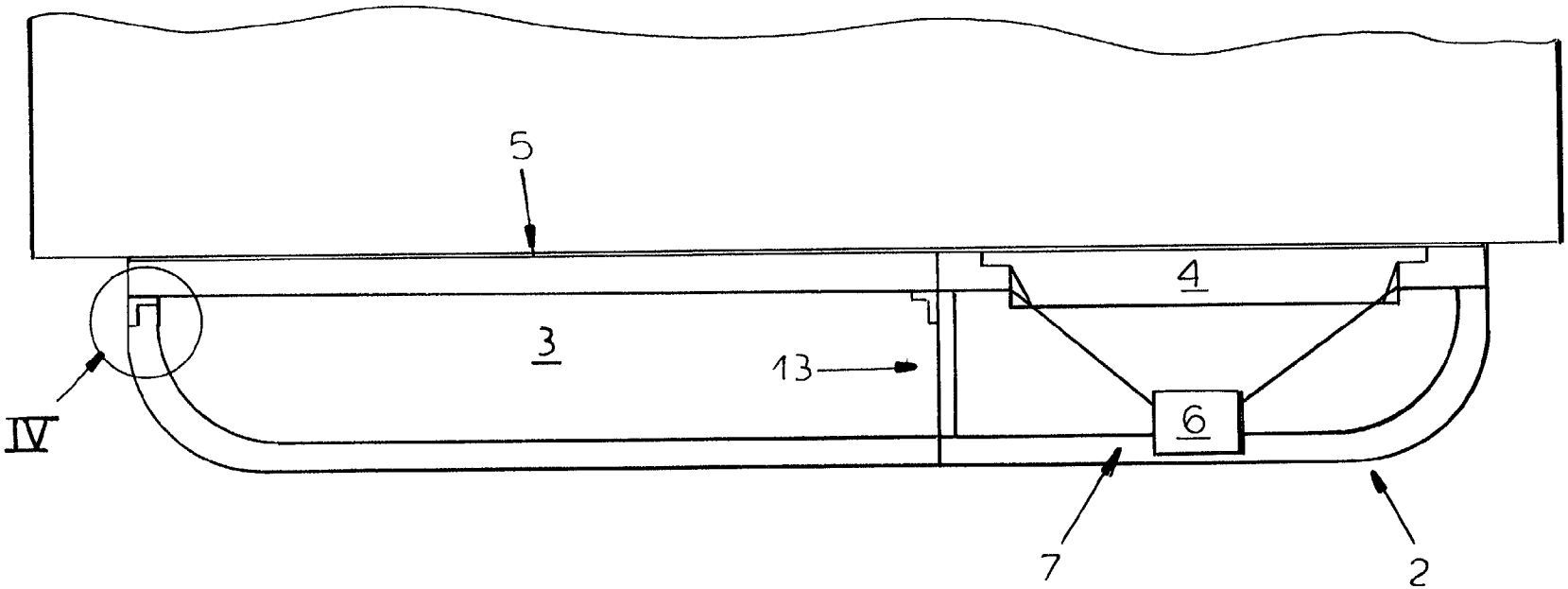
FIG. 3 is a side view of the briefcase according to the invention.

In FIG. 3 shows a side view of the briefcase. On the right side of the housing 2, the loudspeaker 4 is arranged such that the magnet 6 of the woofer 4*a* is located in the lower region of the loudspeaker in the sandwich structure 7, which preferably consists of aluminum, balsa and fiberglass. The space shown in FIG. 3 on the left for storing objects is connected with the region of the housing, in which the loudspeaker 4 is arranged, by means of an opening 13 having a screen which passes air. Thereby it is ensured that the air in the resonance chamber 3 vibrates with the loudspeaker 4 and contributes to a natural sound reproduction in particular in the low frequency range.

Figure 4:
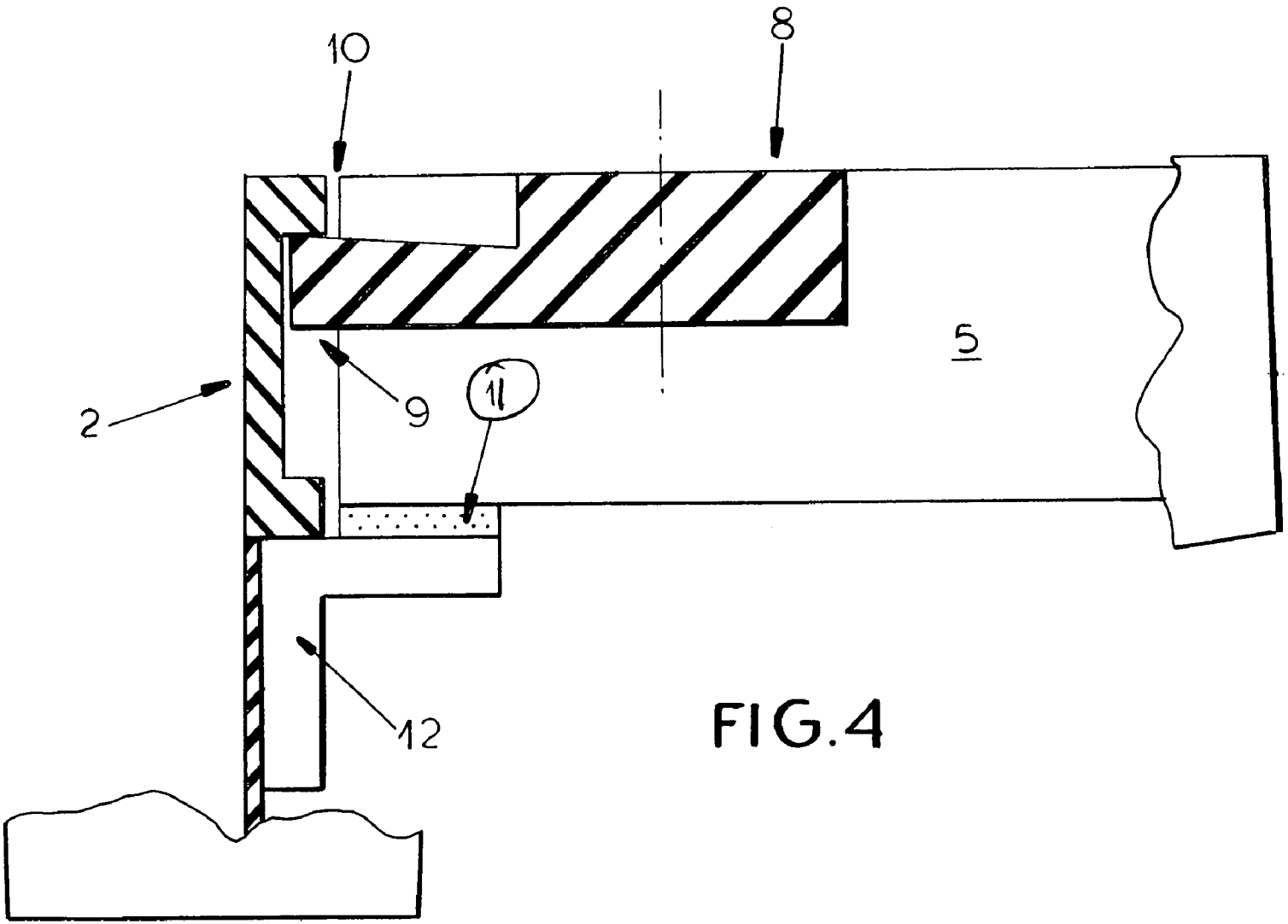
FIG. 4 is a section of the side view according to FIG. 3.

FIG. 4 shows a sectional view of the side view shown in FIG. 3, in particular the region in which the outer or inner wall 5 is arranged in the housing. Since this wall serves to close the resonance chamber 3, it must be ensured that a satisfactory closure is achieved. As is shown in FIG. 4, a thumbscrew fastener 8 is provided in the side of lid 5. The thumbscrew fastener 8 comprises a latch 9, which in a first position extends outwardly and interacts with a ridge 10 in the housing such that the lid 5 cannot be moved upwardly. In a second position, which is a 90° rotation from the first position, the latch 9 is positioned in the lid respectively in the wall so that the lid may be moved upwardly without any resistance.

The latch 9 is structured such that its thickness in the region in which it interacts with the ridge 10 increases during rotation from the second position into the first position and thereby presses the lid 5 downwardly against a gasket 11. The gasket 11 is arranged on an L shaped ledge 12 and causes a satisfactory closure of the resonance chamber 3.

Figure 5:
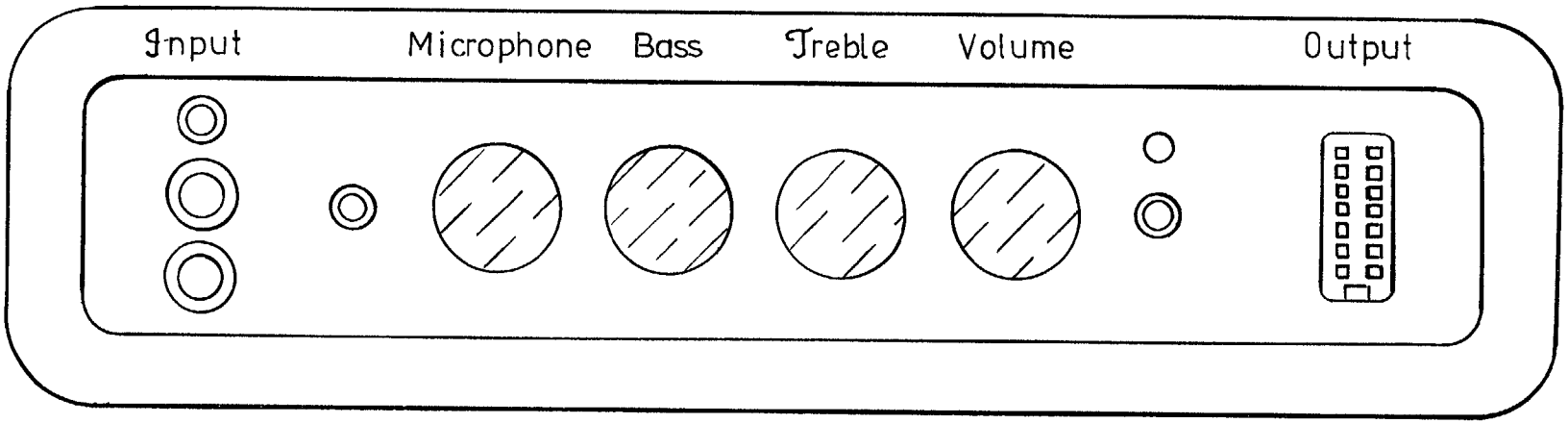
FIG. 5 is a view of a preferred embodiment of the interface for connections.

FIG. 5 shows a view of a preferred embodiment of the interface of connections in which input and output connections as well as controllers for volume, bass, treble and a connection for a microphone are provided.

I claim:

1. A carrying case for electronic devices or documents having a housing wherein the walls of the housing are of a multi-layered or sandwich construction consisting of at least one first layer of material with a maximum thickness of 4 mm and a high modulus of elasticity in shear, and of at least a second inner layer of material with a minimum thickness of 4 mm and a high modulus of elasticity in shear, high damping and low density, and of a third layer of material with a maximum thickness of 4 mm and a high modulus of elasticity in shear, said housing comprising:

at least one loudspeaker for reproduction of audio frequencies mounted on one of said walls of the housing;

at least one storage compartment for storing paper, documents, electronic devices or objects; said storage compartment which serves to create a loudspeaker enclosure for reproduction of low frequencies when closed.

2. The carrying case according to claim 1 wherein the walls of the housing are of a multi-layered or sandwich construction consisting of at least on first layer comprising a material with a maximum thickness of 4 mm and a high modulus of elasticity in shear, and of at least a second layer of material with a minimum thickness of 4 mm and a high modulus of elasticity in shear, high damping and low density, and of a third layer of material with a maximum thickness of 4 mm and a high modulus of elasticity in shear, at least one of said layers utilizing one or more materials with anisotropic load-bearing characteristics.

3. The carrying case according to claim 1 wherein the interior of the briefcase is formed with a storage compartment lid with spring latches and elastic gaskets to serve as a passive loudspeaker membrane or passive loudspeaker membrane suspension for a passive-radiator loudspeaker enclosure design.

4. The carrying case according to claim 1, wherein a movable interior wall for said storage compartment is included which serves to create said loudspeaker enclosure for reproduction of low frequencies when positioned on said at least one storage compartment.

5. The carrying case according to claim 1, wherein the housing comprises two mateable shells which are connected by means of a hinge.

6. The carrying case according to claim 5, wherein the hinge is separable.

7. The carrying case according to claim 5, wherein the movable interior wall forms a lid for said storage compartment which can be opened and closed.

8. The carrying case according to claim 7, wherein the lid is in the form of a pan with a deep bottom.

9. The carrying case according to claim 1, wherein the storage compartment forms a resonance chamber and is lined with an acoustic damping material of at least 4 mm thickness which protects items stored therein and causes a damping of acoustic waves of the loudspeaker.

10. The carrying case according to claim 1 further comprising interface means for connections to the loudspeaker.

11. The carrying case according to claim 1, further comprising a volume control potentiometer for the loudspeaker.

12. The carrying case according to claim 10, further comprising an electrical amplifier means for increasing and controlling the loudness of the audio signal provided to the loudspeaker.

13. The carrying case according to claim 10, wherein the interface means for connections comprise a microphone connection.

14. The carrying case according to claim 10, wherein the interface means for connections comprise a connection for an external power source.

15. The carrying case according to claim 10, further comprising an energy source in the form of a battery in said housing.

16. The carrying case according to claim 10, wherein the interface means for connections comprise means for sending and receiving analog and digital signals by means of radio or infrared frequency.

17. The carrying case according to claim 1 wherein the housing comprises mounting means for mounting the speaker selectively to a stand or to a wall.

18. A carrying case for electronic devices or documents having a housing wherein the walls of the housing are of a multi-layered or sandwich construction consisting of at least one first layer of material with a maximum thickness of 4 mm and a high modulus of elasticity in shear, and of at least a second inner layer of material with a minimum thickness of 4 mm and a high modulus of elasticity in shear, high damping and low density, and of a third layer of material with a maximum thickness of 4 mm and a high modulus of elasticity in shear, at least one of said layers utilizing one or more materials with anisotropic load-bearing characteristics, said housing comprising:

at least one loudspeaker for reproduction of audio frequencies mounted on one of said walls of the housing;

at least one storage compartment for storing paper, documents, electronic devices or objects; said storage compartment which serves to create a loudspeaker enclosure for reproduction of low frequencies when closed.

19. A carrying case for electronic devices or documents having a housing wherein the walls of the housing are of a multi-layered or sandwich construction consisting of at least one first layer of material with a maximum thickness of 4 mm and a high modulus of elasticity in shear, and of at least a second inner layer of material with a minimum thickness of 4 mm and a high modulus of elasticity in shear, high damping and low density, and of a third layer of material with a maximum thickness of 4 mm and a high modulus of elasticity in shear, said housing comprising:

at least one loudspeaker for reproduction of audio frequencies mounted on one of said walls of the housing;

at least one storage compartment for storing paper, documents, electronic devices or objects; said storage compartment which serves to create a loudspeaker enclosure for reproduction of low frequencies when closed;

wherein the interior of the briefcase is formed with a storage compartment lid with spring latches and elastic gaskets to serve as a passive loudspeaker membrane or passive loudspeaker membrane suspension for a passive-radiator loudspeaker enclosure design.

* * * * *